US007041032B1

(12) United States Patent
Calvano

(10) Patent No.: US 7,041,032 B1
(45) Date of Patent: May 9, 2006

(54) WRIST BAND WORKOUT DISPLAY

(76) Inventor: Robert T. Calvano, 41 Woodward Hts., Pleasant Ridge, MI (US) 48069

( * ) Notice: Subject to any disclaimer, the term of this patent is extended or adjusted under 35 U.S.C. 154(b) by 694 days.

(21) Appl. No.: 10/092,207

(22) Filed: Mar. 5, 2002

(51) Int. Cl.
*A63B 21/00* (2006.01)

(52) U.S. Cl. ..... 482/4; 482/44; 482/148; 368/41

(58) Field of Classification Search ..... 482/4, 482/44, 49, 50, 148; 273/440; 224/164, 224/165; 281/45; 368/41–44
See application file for complete search history.

(56) References Cited

U.S. PATENT DOCUMENTS 1,539,781 A * 5/1925 Smythe ..... 224/165
3,722,885 A * 3/1973 Leaf ..... 273/440
4,903,250 A * 2/1990 Cho ..... 368/41
4,905,321 A 3/1990 Walunga
4,906,025 A * 3/1990 Schreindl ..... 281/45
4,923,418 A 5/1990 Hoffman
5,341,972 A * 8/1994 Jacks ..... 224/165
5,944,633 A 8/1999 Wittrock
6,126,572 A 10/2000 Smith
6,443,341 B1 * 9/2002 Rittmann ..... 224/219

OTHER PUBLICATIONS www.sportsdepot.com, Wrist Coach.byNeumann.
www.paceband.com, Pace Band for runner's split times.

* cited by examiner

*Primary Examiner*—Glenn E. Richman
(74) *Attorney, Agent, or Firm*—Richard L. Marsh

(57) ABSTRACT

An apparatus and method for displaying data regarding a weightlifting workout or other exercise routines, specifically repetitions, sets performed, and durations of rest for various exercises. The apparatus includes a watch and a means for holding one of a plurality of data cards. Each data card comprises a specific workout routine including various exercises, the number of repetitions for each exercise and durations of rest between each exercise.

6 Claims, 7 Drawing Sheets

WRIST BAND WORKOUT DISPLAY

BACKGROUND OF THE INVENTION

1. Field of the Invention

This invention relates to a method and apparatus for an exercise workout, more particularly to a weightlifting workout and generally comprises an exercise aid comprising a wrist band, a timepiece and at least one exercise routine card, the wrist band having means for carrying the timepiece, means for carrying the exercise routine card and means for displaying the exercise routine card.

2. Prior Art Statement

Bodybuilders, athletes, conditioning coaches, personal trainers, physical therapists as well as individuals engaged in weight training for fitness and conditioning all share a common need, that is, a way of displaying, carrying and tracking workouts. Previously, handwritten data regarding a workout was provided on a paper, notebook or chart supplied by the gym or a fitness speciality company. This method of displaying and creating a workout is cumbersome and inefficient since paper and a writing instrument must be carried around to various workout stations. Furthermore, these paper instruments may be easily damaged, for instance sweat may drip onto the paper instrument smearing or obliterating the workout written thereon. Finally, one tracking a workout on paper medium must improvise in order to put the data into an organized format. Other limitations to the prior art are described below.

It is known to wear a glove during a weightlifting workout and also to wear a wrist band to strengthen the wrist during certain routines. The U.S. Pat. No. 4,905,321 issued on Jun. 6, 1990, to Allen R. Walunga provides a wristband affixed directly to the glove. No prescribed exercise routine nor watch is associated with this band, the glove is used in the usual manner to enhance the grip on the bar and the band is merely to support the wrist.

It is also known to provide an exercise glove having pockets on both sides for containing weights. No watch is associated with the glove, no prescribed exercise routine is provided nor is there any window for observing. For instance, see the U.S. Pat. No. 4,923,418 issued on May 8, 1990 to Ned Hoffman.

It is further known to provide a portable apparatus having a time and calendar function, display window, multiple workout routines and means for tracking an athlete's workouts all stored in electronic memory accessible by a keyboard. The workout routines may be either selected from set routines or customized by the athlete. For instance, see U.S. Pat. No. 5,944,633 issued on Aug. 31, 1999 to Paul Wittrock. This improves upon the hand written method but requires the user to carry the portable apparatus to each workout station, place it in a safe place and retrieve same after every station. Furthermore, exercise data must be recorded in the key pad, a difficult task at best when hands and body are covered in sweat.

Additionally, it is also known to provide a visual display of exertion data that senses exertion on one side of the device and converts it to a visual output visible on a screen on the exposed sided of the device. For instance, see the U.S. Pat. No. 6,126,572 issued on Oct. 3, 2000 to Carl M. Smith. No exercise routine is displayed nor is one contemplated in this device.

Football players, especially quarterbacks, wear a "Wrist Coach" on the forearm having coded information for specific sequence of plays or defense/offense schemes for use during the game. No watch is associated with the band nor is the "Wrist Coach" intended to provide prescribed exercise routines to be recorded as complete workouts. The 'Wrist Coach' is available at sports stores throughout the country and from Sports Depot at 160 08 Crossbay Blvd, Howard Beach N.Y. 11414.

Finally, it is known to provide an individual wrist band having specific split times for marathon training. Thirty-three different running paces are provided, each on a separate band. No watch is associated with any of these individual wrist bands though it is obvious that a separate watch would be required to check the split times. Additionally, there is no prescribed exercise routine intended to be recorded as a complete workout. For instance, see the website of Darris Blackford at "www.paceband.com" and insert the sentence "This individual wrist band may be ordered from Darris Blackford at 61 W. Henderson Rd., Columbus, Ohio 43214."

SUMMARY OF THE INVENTION

The prior art recited above has limitations as herein described and thus there is a need for a simple method and apparatus for accurately and consistently displaying a complete weight lifting workout which can thereafter be recorded as a complete exercise. Therefore, it is an object of this invention to provide an exercise aid that comprises a wrist band, a timepiece and at least one exercise routine card, the wrist band having means for carrying the timepiece, means for carrying the exercise routine card and means for displaying the exercise routine card.

Another object of this invention is to provide a wrist band for an exercise aid, the wrist band having means for carrying an exercise routine card that comprises a pocket affixed to a top side or exterior surface of the wrist band.

A further object of this invention is to provide a wrist band comprising an elastic sleeve adapted to be telescopically received over the hand of a user and disposed about the wrist of the user, the elastic band having means for carrying a timepiece, means for carrying an exercise routine card and means for displaying the exercise routine card wherein the timepiece is removably affixed to an exterior surface of the elastic wrist band.

A feature of this invention is to provide an elastic wrist band having a timepiece removably affixed to an exterior surface of the elastic wrist band with a hook portion of a hook and loop fastener.

An additional feature of this invention is to provide an exercise aid having means for carrying an exercise card wherein the means for carrying comprises a transparent material affixed to an exterior surface of the wrist band.

Still another object of this invention is to provide an exercise aid having means for carrying a timepiece and means for carrying an exercise card wherein the means for carrying the timepiece is provided on a top side or exterior surface of the wrist band substantially opposite the means for carrying the exercise card and thus is displayed toward a user of the exercise aid when the user's wrist is in a palm up orientation and the means for carrying the timepiece is displayed toward the user when the user's wrist is oriented palm down.

Still another feature of this invention is to provide an exercise aid having means for carrying a timepiece comprising a hook portion of a hook and loop fastener affixed on one surface at opposed ends of a watch strap wherein the hook portion is adapted to be pressed into engagement with an exterior surface of an elastic wrist band.

One property of this invention is to provide an elastic wrist band having a timepiece removably affixed to an exterior surface of the elastic wrist band with a hook portion of a hook and loop fastener on opposite ends of a watch strap and loop portion of a hook and loop fastener firmly attached to the elastic wrist band.

An added feature of this invention is to provide an elastic wrist band having an exercise routine associated therewith wherein the exercise routine is printed on a separate card and is removably inserted in a pocket affixed to an exterior surface of the elastic wrist band and wherein the pocket has an opening on at least one marginal edge thereof for telescopically receiving the exercise routine card therein.

Still another object of this invention is to provide an exercise aid comprising, in part, a wrist band having means for carrying an exercise routine card which comprises a pocket affixed to a top side or exterior surface of a first separate sleeve, the first separate sleeve adapted to be telescopically disposed upon the wrist band.

Yet another object of this invention is to provide an exercise aid having means for carrying a timepiece which comprises a timepiece affixed to a top side or exterior surface of a second separate sleeve, the second separate sleeve adapted to be telescopically disposed upon a wrist band.

A significant object of this invention is to provide a wrist band for an exercise aid, the wrist band having means for carrying an exercise card comprising a pocket affixed to a top side or exterior surface of a first separate sleeve, the first separate sleeve adapted to be telescopically disposed upon a wrist band carrying a timepiece wherein the timepiece has been previously affixed to the wrist band.

A feature of this invention is to provide an exercise aid comprising a wrist band, a timepiece and at least one exercise routine card, the wrist band having means for carrying the timepiece, means for carrying the exercise routine card and means for displaying the exercise routine card wherein the means for carrying the exercise card comprises a pocket affixed to a top side or exterior surface of the wrist band, the means for carrying the timepiece comprising a timepiece affixed to a top side or exterior surface of a sleeve wherein the sleeve is telescopically disposed upon the wrist band adjacent the pocket.

Another feature of this invention is to provide a wrist band for an exercise aid, the wrist band having means for carrying an exercise routine card that comprises a pocket affixed to a top side or exterior surface of the wrist band wherein the pocket has an opening on at least one marginal edge thereof for telescopically receiving the exercise routine card therein.

Still another object of this invention is to provide a wrist band for an exercise aid, the wrist band having means for carrying an exercise routine card that comprises a pocket affixed to a top side or exterior surface of the wrist band wherein the pocket has a transparent covering on the exposed face thereof for viewing the exercise routine card therethrough.

A property of this invention is to provide an exercise aid having means for carrying an exercise routine card wherein the exercise routine card has one exercise routine displayed on one side thereof and another exercise routine displayed on the opposite side thereof.

Another attribute of this invention is to provide a portable apparatus for displaying a weightlifting workout comprising a wristband, a watch, a pocket and at least one data card, the wristband having the pocket disposed therein, the pocket adapted to receive the at least one the data card telescopically therein, the pocket further having a display window arranged therein wherein one face of the at least one the data card is observable through the window.

Yet another characteristic of this invention is to provide a portable apparatus for displaying a weightlifting workout comprising in part, a pocket on a wrist band for receiving a data card therein wherein one face of the data card has a specific weightlifting exercise routine printed thereon and having the same specific weightlifting exercise routine, another specific weightlifting exercise routine or have identifying data for either specific weightlifting exercise routine printed on a face opposite the one face.

A material attribute of this invention is to provide a method for displaying a weightlifting workout comprising the steps of providing a portable apparatus having a pocket therein, providing a plurality of workout cards, providing a query instruction on an inside surface of the pocket, providing directions on the query instruction, providing a multiplicity of workout routines, providing query instructions on the multiplicity of workout routines wherein the pocket is adapted to receive at least one of the plurality of workout cards therein.

Another meaningful attribute of this invention is to provide a method for displaying a weightlifting workout wherein a query instruction is provided on an inside surface of a pocket disposed on a wrist band, the query instruction observable through a window disposed in one wall of the pocket.

Still another substantial attribute of this invention is to provide a method of displaying a weightlifting workout wherein the directions displayed on a query instruction provided on an inside surface of a pocket disposed on a wrist band prompts a user to insert a first one of a plurality of workout cards in the pocket.

Another meaningful feature of this invention is to provide a method for displaying a weightlifting workout comprising in part, a pocket on a wrist band for receiving a data card therein wherein each one of a plurality of workout cards in a deck of workout cards directs the user to remove the workout card at the completion of the workout routine displayed thereon and further directs the user to insert a second one of the workout cards in the pocket.

Another meaningful feature of this invention is to provide a method for displaying a weightlifting workout comprising in part, a pocket on a wrist band for receiving a data card therein wherein each one of a plurality of workout cards in a deck of workout cards directs the user to remove the workout card from the pocket at the completion of the workout routine displayed on a first side, directs the user to invert the workout card and further directs the user to reinsert the inverted workout cards into the pocket thereby displaying a side opposite the first side.

Finally, it is an object of this invention to provide a deck of exercise routine cards each exercise routine card adapted to be fitted within a pocket of an exercise aid for use by a patient, individual, bodybuilder or athlete wherein the deck of exercise routine cards is customized for the patient, individual, bodybuilder or athlete by a conditioning coach, personal trainer, physical therapist, patient, individual, bodybuilder or athlete.

DESCRIPTION OF THE PREFERRED EMBODIMENTS

While the various features of this invention are hereinafter described and illustrated as an exercise aid comprising a wrist band, a timepiece and at least one exercise routine card, the wrist band having means for carrying the timepiece, means for carrying the exercise routine card and means for displaying the exercise routine card, it is to be understood that the various features of this invention can be used singly or in various combinations thereof as a portable apparatus for displaying a weightlifting workout as can hereinafter be appreciated from a reading of the following description.

Figure 1:
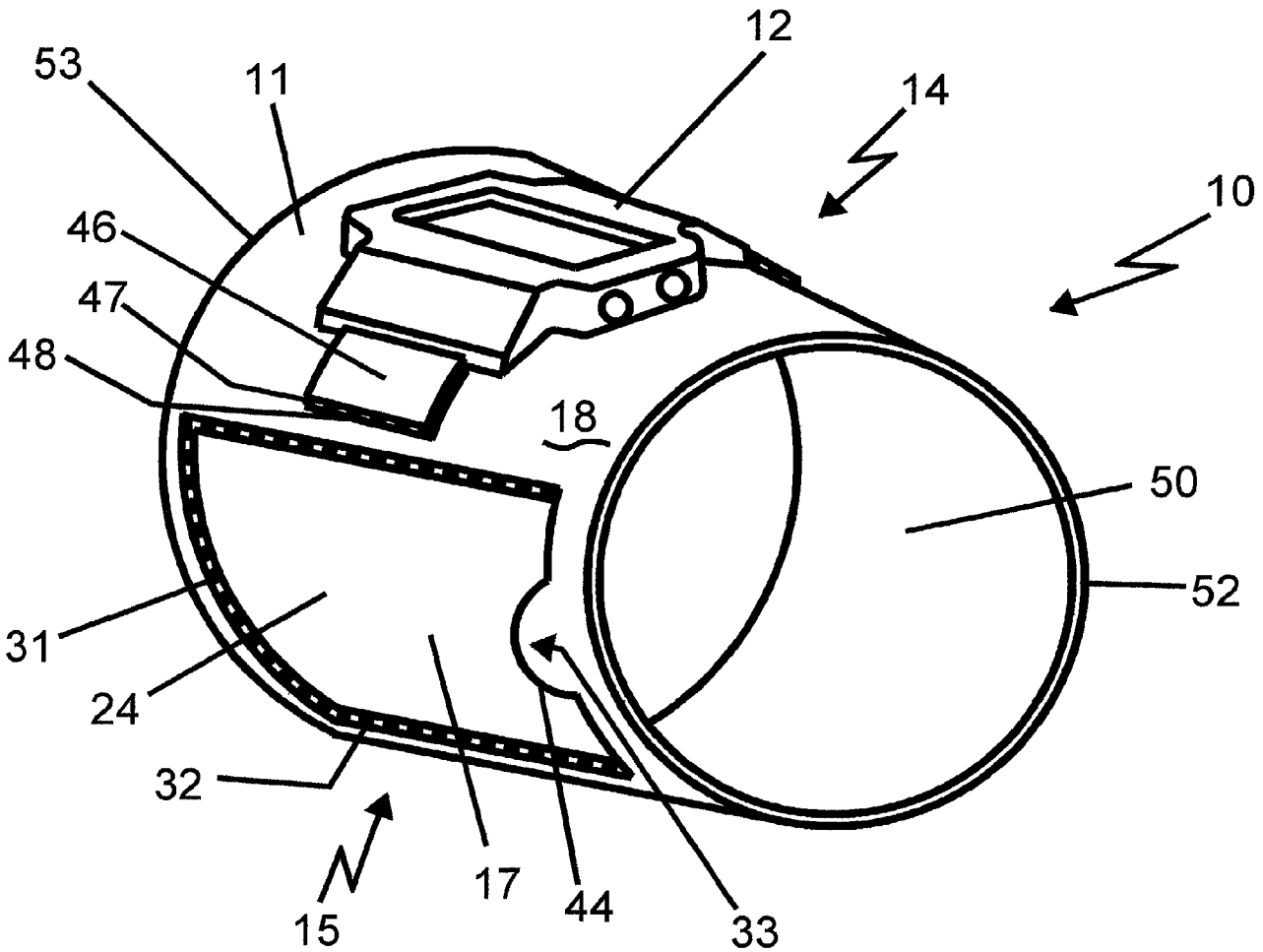
FIG. 1 is a perspective view of the preferred embodiment of the exercise aid of this invention showing a watch affixed to a closed wrist band wherein the watch is disposed opposite the wrist band workout display.
Figure 2:
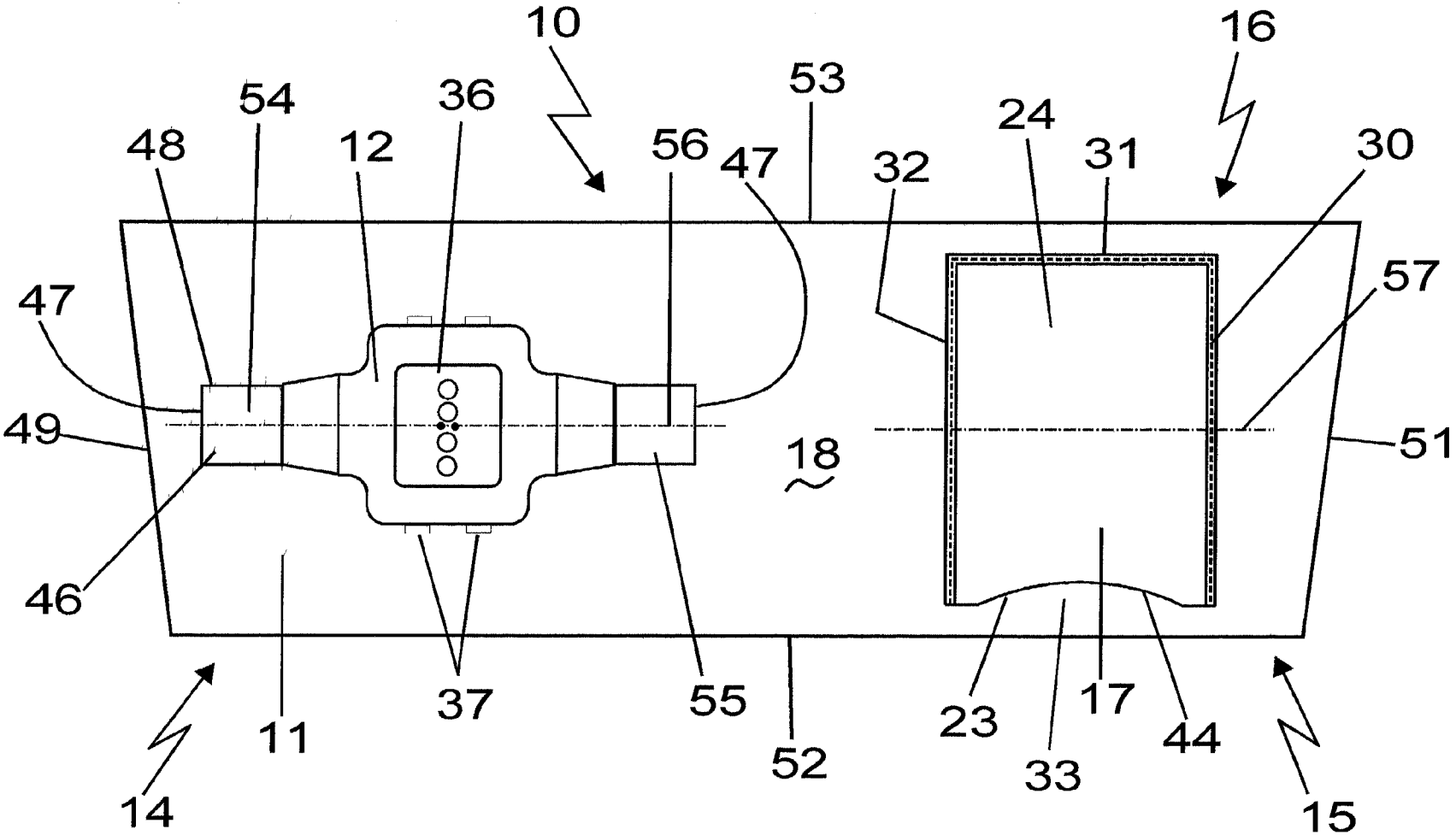
FIG. 2 is a top plan view of the preferred embodiment of the exercise aid of this invention before the mating edges are joined to form the closed wrist band of FIG. 1.
Figure 5:
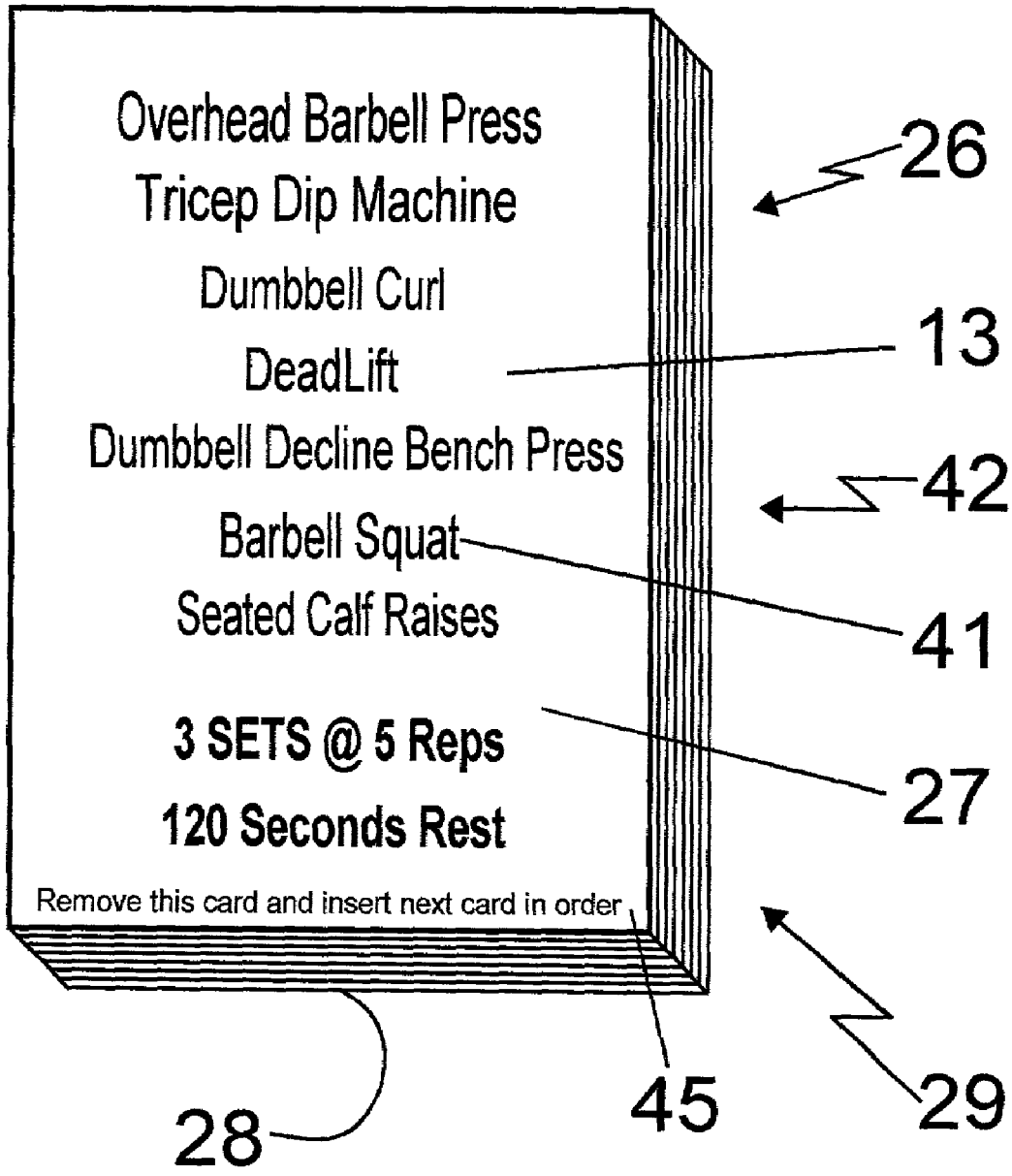
FIG. 5 is an enlarged view of a deck of workout cards showing a weightlifting workout routine displayed on one face of the top card.

Referring first to FIGS. 1, 2 and 5, an exercise aid generally shown by the numeral 10 comprises a wrist band 11, a timepiece 12 and at least one exercise card 13, wrist band 11 having a means 14 for carrying timepiece 12, a means 15 for carrying exercise card 13 and a means 16 for displaying exercise card 13. In the preferred embodiment of FIGS. 1 and 2, wrist band 11 comprises an elastic sleeve adapted to be telescopically received over the hand of a user and disposed about the wrist of the user with the elastic sleeve thus disposed substantially adjacent the hand. The user generally inserts the hand through wrist opening 50 from end 53 through end 52 thus placing end 52 adjacent the wrist. Wrist band 11 is therefore used for multiple purposes, first to strengthen the wrist for weightlifting, secondly to carry and display an exercise routine 26 on an exercise card 13 and finally to carry a timepiece 12 for timing the various specific exercises 41 of exercise routine 26 and rest periods therebetween. In this preferred embodiment, means 15 for carrying said exercise card 13 comprises a pocket 17 affixed to exterior surface 18 of wrist band 11 and preferably comprises a clear thermoplastic sheet sewn along marginal edges 30–32 directly to wrist band 11 leaving edge 23 open for receiving exercise card 13 therein. Preferably, wrist band 11 is slightly convergingly tapered from end 53 to end 52 thus generally conforming to the wrist of the user in the area of the wrist. The taper of wrist band 11 may easily be inferred by referring to FIG. 2 noting that edges 49, 51 are angled with respect to the length of wrist band 11 and thus when edges 49, 51 arejoined to form an enclosed wrist band 11, end 53 is slightly greater in diameter than end 52. Wrist band 11 may be formed from a stretchable thermoset or thermoplastic filament winding material such as spandex or from foamed elastomeric material having a fleece like surface on at least one side thereof. Other materials having expandable properties in at least one direction may also be used to construct wrist band 11. Preferably, wrist band 11 is formed of stretchable thermoset or thermoplastic filament winding material having a length of from about six to 18 inches in retracted form and having a width from about 1 to about 6 inches. Most preferably, wrist band 11 is approximately 8 inches in length and approximately 3 inches in width having edges 49, 51 sewn together to form circular wrist band 11, however, it is fully within the scope of this invention to provide a trailing end for either of edges 49, 51 having another means for joining these ends together. For instance, one of edges 49, 51 may be provided with a hook portion similar to hook portion 47 while the opposite edge 51, 49 may have a loop portion similar to loop portion 48 thereon wherein the hook portion on an edge 49, 51 overlaps an opposite edge 51, 49 and is joined thereto with the hooks gripping into the fabric surface thereof or being affixed to the loop portion 48 provided thereon. Furthermore, though the preferred embodiment comprises an elastic wrist band 11, it is also possible to provide a woven wrist band 11 which does not have elastic properties wherein means 14 for carrying timepiece 12 and means 15 for carrying exercise card 13 may be affixed to the woven wrist band 11 in a manner consistent therewith.

In one embodiment, wrist band 11 of exercise aid 10 has a fabric like grippable exterior surface 18 wherein timepiece 12 may be removably affixed to exterior surface 18 by forcing a hook portion 47 of a hook and loop fastener such as Velero®, a registered trademark of Velcro Industries, N.V., against exterior surface 18 wherein the hooks of hook portion 47 grip into the fabric of exterior surface 18. Preferably, however, a loop portion 48 of a hook and loop fastener is affixed to exterior surface 18 by bonding or sewing same thereto in at least one location on exterior surface 18 where it is desired to affix timepiece 12. Most preferably, two loop portions 48 are affixed to exterior surface 18 spaced a distance apart wherein a hook portion 47 disposed on one surface of each of opposed ends 54, 55 of a short watch band strap 46 is adapted to be mated therewith at one of corresponding loop portions 48 thus removably affixing timepiece 12 to wrist band 11. The reader hereof should easily understand then that hook portion 47 on means 14 for carrying timepiece 12 is pressed into engagement with either exterior surface 18 or loop portion 48 on exterior surface 18 of wrist band 11 thus affixing ends 54, 55 of watch strap 46 to wrist band 11.

Referring again to FIG. 1, exercise aid 10 preferably has means 14 for carrying timepiece 12 provided on exterior surface 18 of wrist band 11 substantially opposite pocket 17 of means 15 for carrying exercise card 13 wherein means 15 for carrying exercise card 13 is displayed toward the user of exercise aid 10 when the user's wrist is in a palm up orientation and means 14 for carrying timepiece 12 is displayed toward the user when the user's wrist is oriented palm down. Though this is the preferred embodiment of the exercise aid 10 of this invention, it is fully within the scope of this invention to place means 14 for carrying timepiece 12 at another location along outer surface 18 of wrist band 11. For instance, timepiece 12 may be placed adjacent means 15 for carrying exercise card 13 by placing hook portions 47 adjacent means 16 for displaying exercise card 13. Alternately, timepiece 12 may have its centerline 56 disposed on a centerline 57 of means 16 for displaying exercise card 13 or may be spaced therefrom as shown in FIG. 2. In another alternate embodiment, means 14 for carrying timepiece 12 may be oriented transverse to the length of wrist band 11 by forcing hook portions 47 of watch band strap 46 into engagement with exterior surface 18 adjacent ends 52, 53 or by attaching hook portions 47 of watch band strap 46 to loop portions 48 provided on exterior surface 18. Generally, opening 33 of pocket 17 faces end 52 of wrist band 11, however it is fully within the scope of this invention to dispose means 15 for carrying exercise card 13 with opening 33 facing end 53. It is also possible for the user to dispose exercise aid 10 upon the wrist with means 14 for carrying timepiece 12 displayed toward the user of exercise aid 10 when the user's wrist is in a palm up orientation and means 15 for carrying exercise card 13 displayed toward the user when the user's wrist is oriented palm down.

In the preferred embodiment shown in FIGS. 1 and 2, exercise aid 10 has means 15 for carrying exercise card 13 therein comprising pocket 17 disposed on exterior surface 18 of wrist band 11 wherein pocket 17 has opening 33 on at least one marginal edge 23, 30–32 thereof for telescopically receiving exercise card 13 therein. Preferably, as pocket 17 comprises a clear thermoplastic sheet sewn directly to exterior surface 18 of wrist band 11, pocket 17 thus comprises a transparent covering 24 on exposed surface 18 thus providing for viewing exercise card 13 therethrough. Since timepiece 12 may be separated from wrist band 11 and exercise card 13 may be removed from pocket 17, wrist band 11 may be laundered in the conventional manner without damage to either timepiece 12 or exercise card 13 thus providing for a considerable improvement over the prior art.

Figure 6:
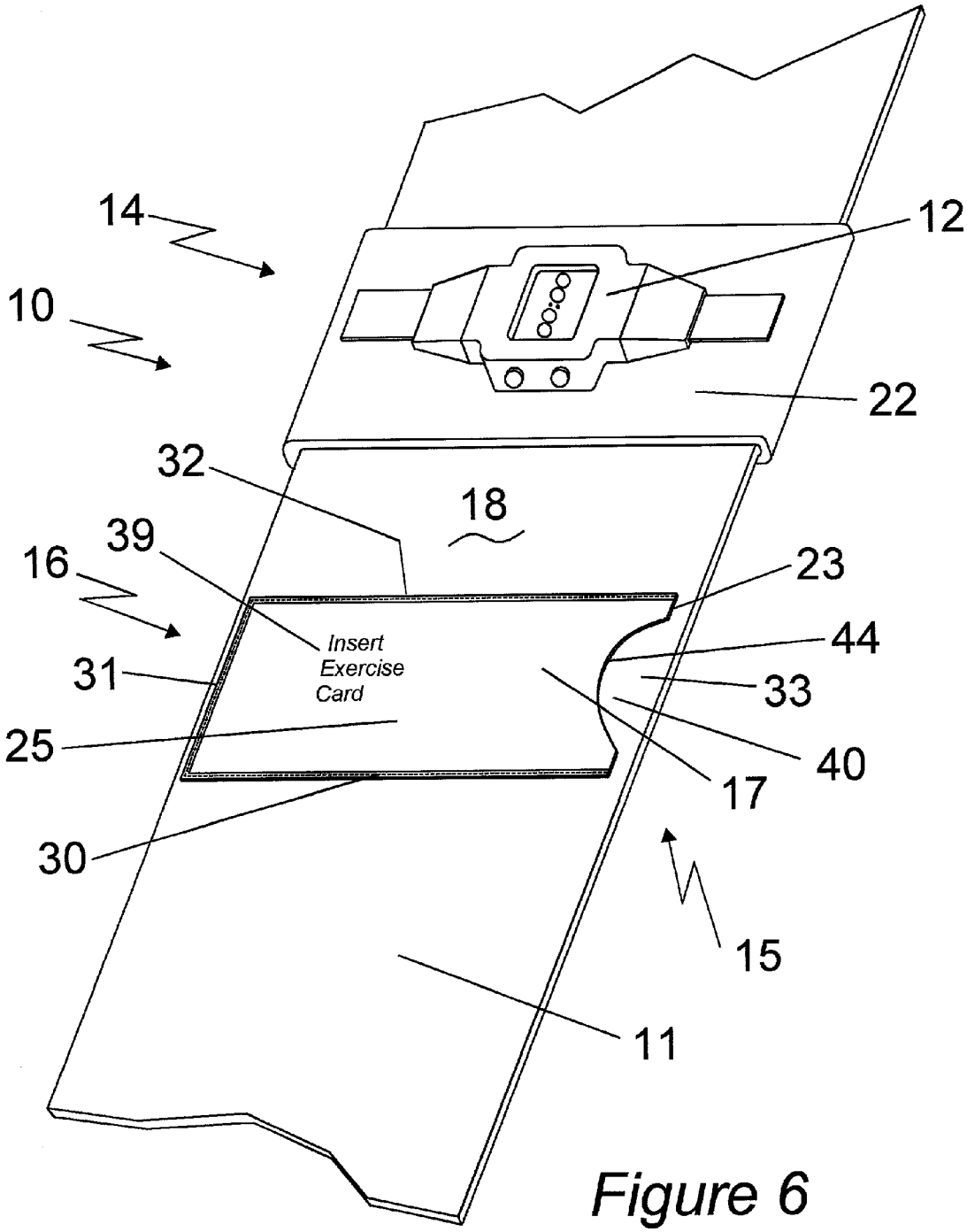
FIG. 6 is a perspective view of another embodiment of the exercise aid of this invention showing a watch affixed to a sliding sleeve with the sleeve slidably disposed on a wrist band for movement adjacent the wrist band workout display.

Referring now to FIGS. 5 and 6, exercise aid 10 comprises separate components, for instance, wrist band 11, a timepiece 12 and at least one exercise card 13. Wrist band 11 has means 14 for carrying timepiece 12, means 15 for carrying exercise card 13 and means 16 for displaying exercise card 13. In the embodiment shown in FIG. 6, means 15 for carrying exercise card 13 comprises a pocket 17 affixed to exterior surface 18 of wrist band 11, however, it will become readily apparent hereinafter that various means 15 for carrying exercise card 13 may be employed. As shown in FIG. 6, pocket 17 comprises a plurality of marginal edges 23, 30–32 of a structure affixed to exterior surface 18 of wrist band 11. In one embodiment, marginal edges 30–32 are sewn to wrist band 11 while marginal edge 23 remains open and unattached to wrist band 11. Thus, opening 33 is created between marginal edges 30, 32 while marginal edge 31 closes pocket 17 opposite opening 33. Marginal edges 30–32 of pocket 17 may be made of the same material as wrist band 11 or may be constructed of a dissimilar material. Pocket 17 comprising marginal edges 30–32 may be made of leather, leather like material, split cowhide, nylon, cotton webbing, neoprene, vinyl or other flexible material which may be readily affixed to wrist band 11 wherein marginal edges 30–32 have transparent window 24 also affixed thereto. Thus, transparent window 24 is disposed between marginal edges 30–32 with opening 33 at marginal edge 23. Preferably, transparent window 24 is a clear thermoplastic material such as transparent vinyl having marginal edges 30–32 directly affixed to wrist band 11 thus constituting pocket 17, however, other transparent materials may be used to advantage for transparent window 24.

Figure 4:
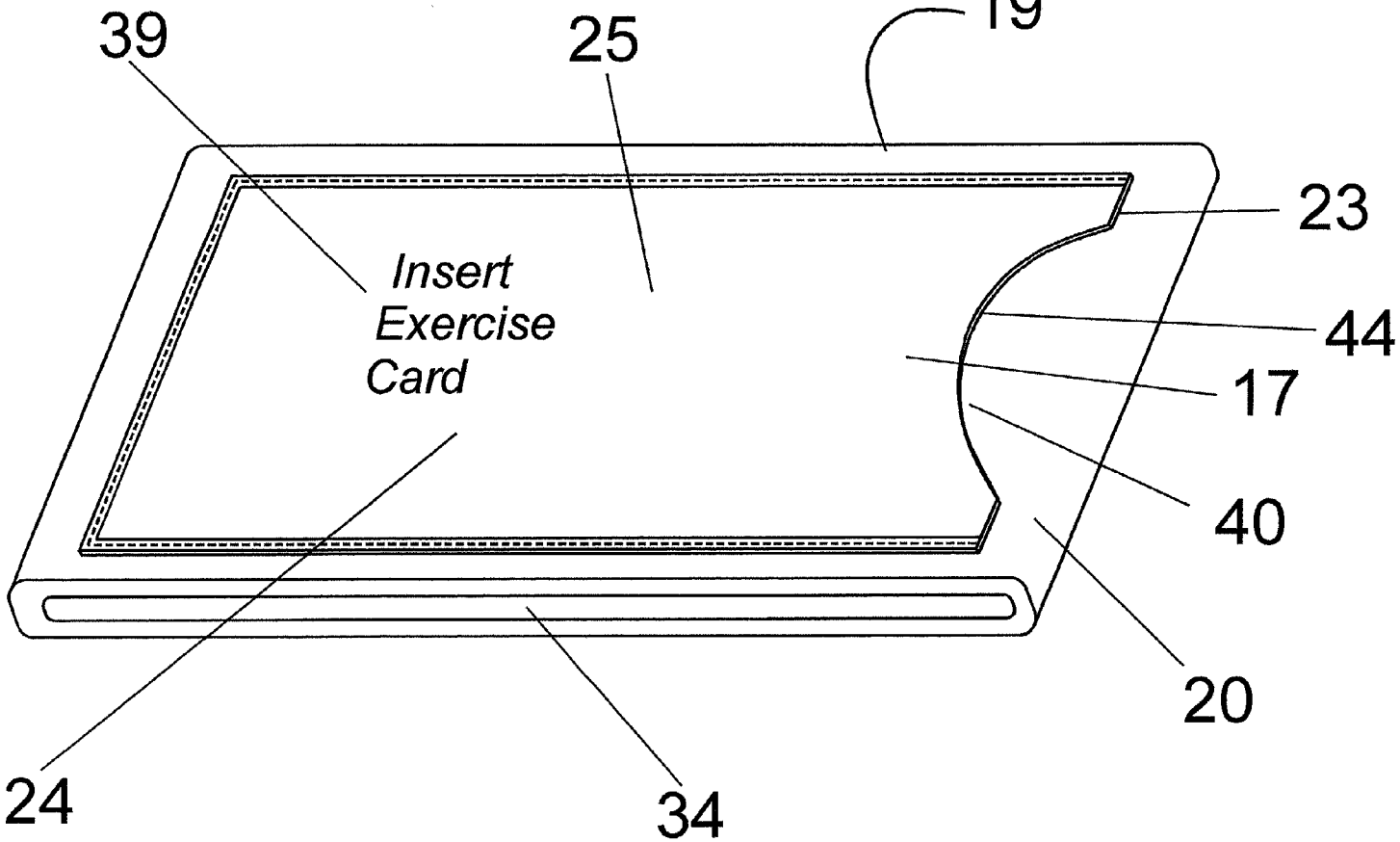
FIG. 4 is an enlarged perspective view of a wrist band workout display affixed to a sliding sleeve.

Pocket 17 may alternately be affixed to exterior surface 19 of first separate sleeve 20 as in FIG. 4 wherein first separate sleeve 20 is adapted to be telescopically disposed upon wrist band 11. Construction of pocket 17 on first separate sleeve 20 is substantially the same as the construction thereof when disposed directly upon wrist band 11, however with pocket 17 disposed on separate sleeve 20, it is possible to use the features of this invention with a conventional wrist watch band, weightlifting wrist band or stop watch band wherein the conventional band becomes wrist band 11 and wherein pocket 17 is slidable telescopically disposed over an open end of the wrist band 11. Where a conventional watch, weightlifting or stop watch band is used for wrist band 11, first separate sleeve 20 has a passage 34 completely therethrough for receiving the conventional wrist band therein. In one embodiment of this invention, exercise aid 10 may have means 15 for carrying exercise card 13 comprising pocket 17 affixed to exterior surface 19 of first separate sleeve 20 wherein first separate sleeve 20 is adapted to be telescopically disposed upon a wrist band carrying timepiece 12 and wherein timepiece 12 is affixed to wrist band 11. For instance, many stop watches are permanently affixed to a band adapted to be worn on the wrist and thus means 15 for carrying exercise card 13 has pocket 17 affixed to exterior surface 19 of first separate sleeve 20 wherein first sleeve 20 can then be disposed telescopically over the end of the existing watch band and placed adjacent timepiece 12 thereby utilizing the existing watch band as wrist band 11. Of course, first separate sleeve 20 may be spaced from timepiece 12 on a conventional watch band. First separate sleeve 20 is preferably made of leather, leather like material, split cowhide, nylon, cotton webbing, neoprene, vinyl or other flexible material formed into a complete loop having passage 34 therethrough, however, first separate sleeve 20 may be an open-ended structure closeable about wrist band 11 as hereinafter described. First separate sleeve 20 is particularly useful for a personal trainer, physical therapist or conditioning coach, hereafter trainer, for individualized work with a patient, athlete or individual, hereafter, patient as the patient may utilize their own wrist watch band for wrist band 11 as there is no particular need for wrist band 11 to potentially supply additional support to the wrist of the patient as may be required for a weightlifter using exercise aid 10.

Figure 3:
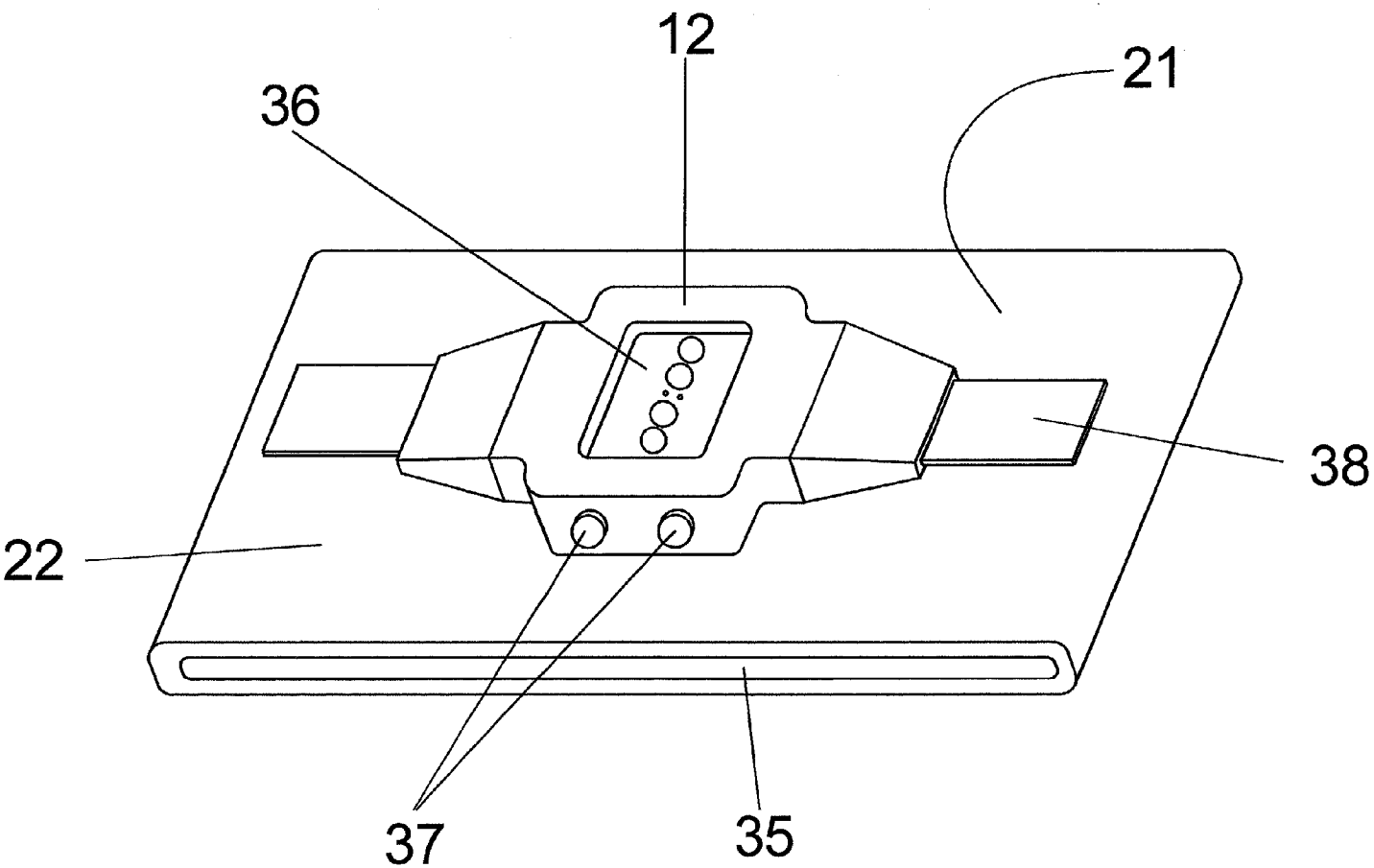
FIG. 3 is an enlarged perspective view of a watch affixed to a sliding sleeve.
Figure 7:
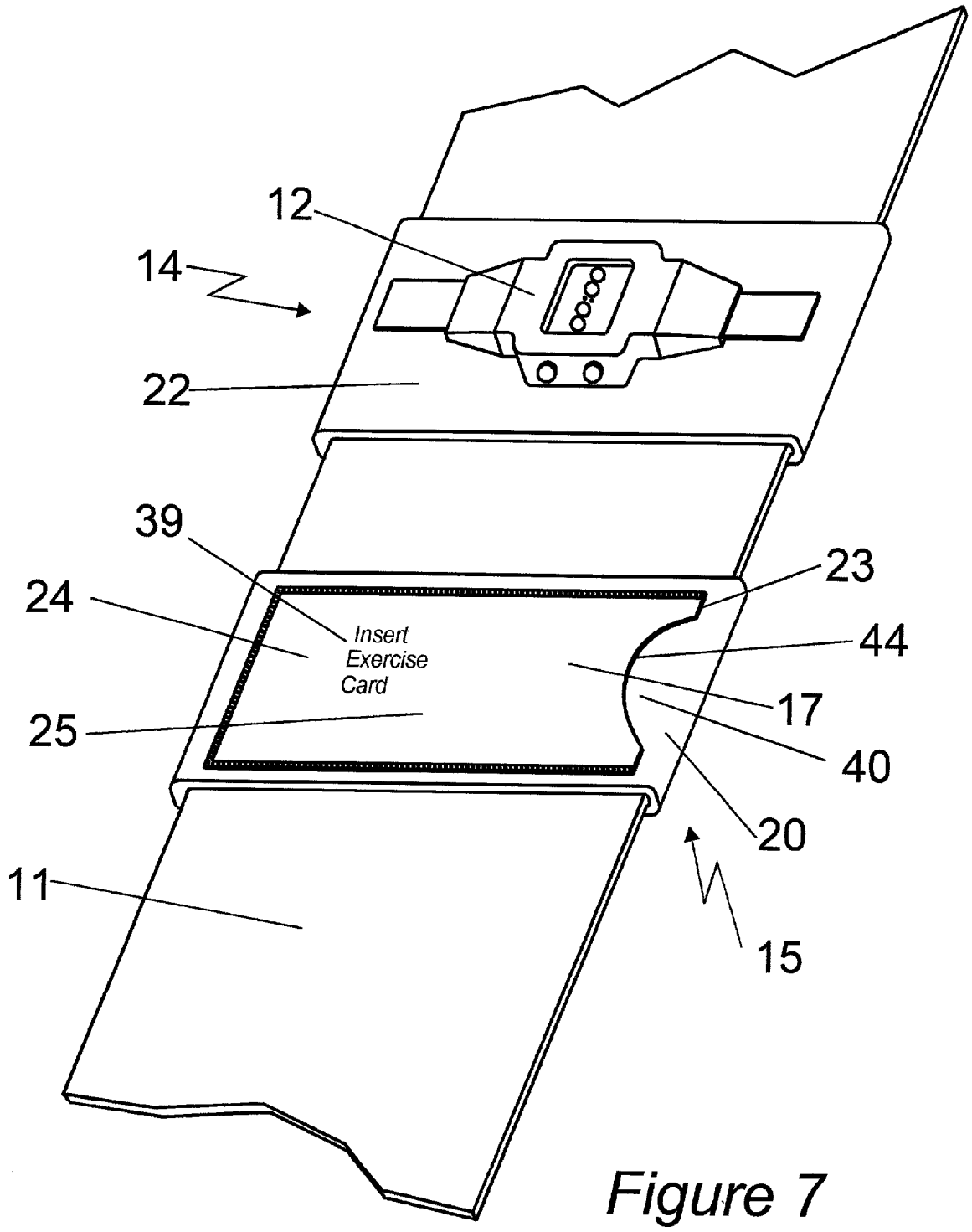
FIG. 7 is a perspective view of another embodiment of the exercise aid of this invention showing a watch affixed to a sliding sleeve and a separate wrist band workout display disposed on another sliding sleeve, both sliding sleeves disposed on a wrist band.

Referring also to FIG. 3, exercise aid 10 may have means 14 for carrying timepiece 12 having timepiece 12 affixed to exterior surface 21 of second sleeve 22, second sleeve 22 then telescopically disposed upon wrist band 11 adjacent pocket 17. For instance, as shown in FIG. 3, means 14 for carrying timepiece 12 may comprise a timepiece 12 such as a stop watch or alarm watch affixed to exterior surface 21 of a second separate sleeve 22 wherein second separate sleeve 22 is adapted to be telescopically disposed upon wrist band 11. In this embodiment, second separate sleeve 22 has a passage 35 passing therethrough, passage 35 adapted to receive wrist band 11 therein such that timepiece 12 may be disposed adjacent first separate sleeve 20 having means 16 for displaying thereon. Second separate sleeve 22 is preferably made of leather, leather like material, split cowhide, nylon, cotton webbing, neoprene, vinyl or other flexible material formed into a complete loop having passage 35 therethrough, though second separate sleeve 22 may be closeable about wrist band 11 in a manner similar to a closeable sleeve described for first separate sleeve 20. Timepiece 12 is affixed to second separate sleeve 22 such that timepiece 12 may be readily viewed by the wearer of exercise aid 10. FIG. 3 shows timepiece 12 disposed transverse second separate sleeve 22 though, of course, the placement and orientation of timepiece 12 depend primarily upon the location of access and control buttons 37 and the orientation of the numerals on the watch face 36 such that viewing is possible without rotating the wrist or elevating the forearm to an unusual position. In this manner, as shown in FIG. 7, first separate sleeve 20 and second separate sleeve 22 may be disposed upon a weightlifter's wrist support band thus utilizing the wrist support band as wrist band 11 wherein means 14 for carrying timepiece 12 and means 15 for carrying exercise card 13 may be positioned upon wrist band 11 for the comfort of the user without sacrificing support to the wrist. In FIG. 7, means 15 for carrying exercise card 13 is shown disposed substantially adjacent means 14 for carrying timepiece 12 upon wrist band 11, however it is to be fully understood that means 15 for carrying exercise card 13 may be disposed remote from means 14 for carrying timepiece 12. Various wrist straps used in weightlifting are available at sporting goods stores or at on-line sites. These wrist straps usable as wrist band 11 may comprise power lifting straps of woven cotton duck, lifting hook straps with hook and loop fasteners adapted to close an open-ended strap about the wrist, leather straps with various closures, flexible, soft neoprene wrist straps generally closeable with hook and loop fasteners, woven nylon or cotton strapping having a cinching strap affixed thereto the cinching strap having a hook and loop fasteners adapted to be passed through a cinch buckle on one end of the woven strap and close the open ended cinching strap about the wrist, sport tape or the like. The various wrist straps usable for wrist band 11 may further have soft pads disposed on the inside surface thereof to provide comfort to the wrist of the user. When using an open-ended strap for wrist band 11, first sleeve 20 for means 15 for carrying exercise card 13 and second sleeve 22 for means 14 for carrying timepiece 12 may be adjusted by the user to a position for comfort and ease of viewing.

In any embodiment of pocket 17 recited herein, pocket 17 has opening 33 on at least one marginal edge 23, 30–32 thereof for telescopically receiving exercise card 13 therein. Additionally, pocket 17 has a transparent covering 24 on the exposed face 25 thereof for viewing exercise card 13 through transparent covering 24, exposed face 25 adapted to be disposed on wrist band 11 for ease of viewing by the user of exercise aid 10. Wrist band 11 is adapted to be secured to the lower forearm preferably around the wrist of the user, with exposed face 25 facing upwardly from the backside of the forearm such that as the forearm is rotated toward the face of the user of exercise aid 10 in a manner consistent with viewing a watch, both timepiece 12 and exercise card 13 are simultaneously visible to the user. In some instances, however, it may be beneficial to have timepiece 12 spaced from exercise card 13 and thus having either or both of first sleeve 20 and/or second sleeve 22 slidably telescopically disposed on wrist band 11, it is simple to space timepiece 12 from exercise card 13. Sleeves 20, 22 have hereinbefore been described as closed sleeves having a open passage 34, 35 respectively, however, it is fully within the scope of this invention to provide first sleeve 20 and/or second sleeve 22 as an open-ended strip of material having a closure on the opposing ends whereby first sleeve 20 and/or second sleeve 22 so produced may be wrapped around wrist band 11 and closed thereonto using the closure provided on the opposing ends. Such a closure may comprise a hook and loop fastener system or other such closure as desired by the manufacturer thereof. Where a closeable strip is used to construct first sleeve 20 and/or second sleeve 22, the construction of pocket 17 remains substantially as described above.

As transparent covering 24 is readily visible to the user of exercise aid 10, exercise card 13 may have one exercise routine 26 displayed on one side or face 27 thereof and another exercise routine 26 displayed on opposite side or face 28 thereof. Alternately, exercise card 13 may have the same exercise routine 26 displayed on both faces 27, 28 thereof to minimize the risk that a user would use an incorrect exercise routine 26. It is also possible to have a lengthy workout routine 26 displayed partly on one face 27 with a continuation of workout routine 26 displayed on reverse face 28 wherein an instruction 45 on one face 27 directs the user thereof to invert exercise card 13 for the remainder of exercise routine 26. Preferably, however, exercise card 13 has identifying data for specific exercise routine 26 printed on face 28 opposite one face 27. The identifying data may comprise a name for specific exercise 41, a name for exercise routine 26, a trade name, a slogan, sequence number for that specific card 13 of deck 29, a trainer's name, a day/week/month sequence and combinations of the above.

In the instant invention, a combination of a wrist band 11, a timepiece 12, a data card 13 and pocket 17 for displaying data card 13 is provided wherein timepiece 12 and pocket 17 for displaying data card 13 are associated with wrist band 11. Data card 13 comprises at least one workout routine 26 disposed on at least one face 27 of data card 13, wrist band 11 having pocket 17 disposed thereon wherein pocket 17 is adapted to receive data card 13 telescopically therein from one side edge 23, 30–32, pocket 17 further having a display window 24 arranged therein wherein one face 27, 28 of data card 13 is observable through window 24. For instance, pocket 17 may have marginal edges 30–32 provided with hook material on the underside thereof such that marginal edges 30–32 may be readily affixed to loop material on a conventional workout wrist strap used as wrist band 11. Similarly, timepiece 12 may be affixed to wrist band 11 with hook material supplied on the underside of tabs 38 of timepiece 12 or ends 54, 55 of a watch strap 46 where watch strap 46 is associated with timepiece 12. Other means of affixing pocket 17 and/or timepiece 12 to wrist band 11 may be employed without departing from the scope of this invention.

The combination recited above preferably has a specific weightlifting exercise routine 26 printed on at least one face 27, 28 of data card 13 wherein the exercise routine 26 may be readily observed through window 24 and protected from environmental factors by pocket 17. Preferably also, data card 13 is only one of many data cards 13 of a deck 29 of exercise cards 13, wherein deck 29 has been established by a professional trainer to ensure that each exercise routine 26 has specific exercises 41 to achieve certain fitness and/or strength goals and wherein exercise routine 26 also has rest periods between specific exercises 41 to properly rest the muscles being exercised. Other decks 29 may comprise data cards 13 for improving strength, musculature, fitness and/or endurance of an athlete or patient or for rehabilitation of damaged tissue, recuperation from surgery or to prevent atrophy of the certain parts of body for patients which are substantially bedridden. Therefore, the combination recited above may have one data card 13 with one specific exercise routine 26 on one face 27 and another specific exercise routine 26 printed on a face 28 opposite face 27. Particularly, it is contemplated that one data card 13 has one specific weightlifting routine 26 on one face 27 and another specific weightlifting exercise routine 26 printed on a face 28 opposite one face 27. Likewise, the combination above may have one data card having the same specific weightlifting exercise routine 26 printed on both faces 27, 28 such that it becomes immaterial which face 27, 28 is presented to the user thus making insertion and removal of exercise cards 13 simpler for an exercising athlete.

A method for displaying a weightlifling workout routine 26 comprises the steps of providing a portable apparatus 10 having a pocket 17 therein, providing a plurality of workout cards 13, providing a query instruction 39 on an inside surface 40 of pocket 17, providing directions 45 on query instruction 39, providing a multiplicity 42 of workout routines 26 in a deck 29, providing multiplicity 42 of specific exercises 41 comprising each of workout routines 26 wherein pocket 17 is adapted to receive at least one of workout cards 13 therein. In the method of displaying a weightlifting workout, query instruction 39 is preferably observable through window 24 disposed in exposed face 25 of pocket 17, however, query instruction 39 may be disposed on one marginal edge 30–32 of pocket 17 or may be disposed in inside surface 40 at cutout 44 of marginal edge 23 wherein pocket 17 is opened. The method of displaying a weightlifting workout preferably also has directions 45 such as query instruction 39 which prompt the user thereof to insert a first one ofworkout cards 13 in pocket 17 wherein these directions 45 may be provided as query instructions 39 on inside surface 40 or may be disposed on a first card in deck 29 or may be provided verbally by a trainer. Preferably also, the method of displaying a weightlifting workout has directions 45 on each of cards 13 in deck 29 as shown on the top card of deck 29 in FIG. 5, wherein direction 45 on this first workout card 13 directs the user to remove the first one of workout cards 13 at the completion of the workout routine 26 displayed thereon and further directs the user to insert a second one of workout cards 13 in pocket 17.

The method of displaying a weightlifting workout described in this invention provides for directions 45 on a first face 27 of a first one of workout cards 13 that directs the user to remove the first one of workout cards 13 at the completion of the workout routine 26 displayed on first face 27, directs the user to invert the first one of workout cards 13 and further directs the user to reinsert the inverted first one of workout cards 13 into pocket 17 thereby displaying a face 28 opposite first face 27. In one instance, face 28 opposite first face 27 of the first one of workout cards 13 has a continuation of exercise routine 26 from first face 27 disposed on second face 28, however, second face 28 may have another direction 45 thereon. For instance, for rehabilitation exercises, a stop instruction may be disposed on face 28 wherein the user thereof is directed further to return exercise card 13 to the trainer and record the completion of the workout routine 26 on an automatic or manual device. Second face 28 may alternately have direction 45 directing the user thereof to select another exercise card 13 as described above or may direct the user to consult the trainer. In yet another instance, second face 28 opposite said first face 27 of the first one of workout cards 13 has another exercise routine 26 disposed thereon.

Though the portable apparatus or exercise aid 10 and method herein has been described as applicable to a weightlifting workout, the method and apparatus 10 are equally applicable to other exercise routines 26. For instance, a trainer may prepare a deck 29 of cards personalized for each patient under the care of the trainer and thereafter track the progress of the patient merely by recording the number, indicator or exercise card name on the patient's record. Using the exercise aid 10 and method of this invention provides the trainer with ample time to assist multiple patient during the course of each patient's exercise routine 26 by merely consulting the exercise aid 10 worn by the patient requiring assistance. It is readily apparent here that the trainer may create multiple exercise cards 13 having exercise routines 26 thereon for all levels of conditioning, endurance ability, age or physical limitation, each deck 29 of cards 13 customized for specific patients yet wherein individual cards from a deck 29 previously used for one patient may be inserted into another deck 29 to create yet another specific set of exercise routines 26. Of course, one deck 29 having a particular set of exercise routines 26 therein may be used for the same course of rehabilitation, conditioning or fitness for multiple patients wherein scheduling of these patients at different times would be beneficial. Preferably, individual exercise cards 13 are prepared by a trainer, however, these cards may have established workout routines 26 such as available from Sport Coach at the website of Brian Mackenzie. Preferably also, individual exercise cards 13 are laminated with a moisture impervious laminate upon completion of exercise routines 26 and directions 45 on faces 27, 28 thereof.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. An exercise aid comprises a wrist band, a timepiece and at least one exercise routine card; wherein said means for carrying said exercise card comprises a pocket affixed to an exterior surface of said wrist band; wherein said means for carrying said timepiece is provided on said exterior surface of said wrist band substantially opposite said pocket wherein said means for carrying said exercise card is displayed toward an user of said exercise aid when said user's wrist is in a palm up orientation and said means for carrying said timepiece is displayed toward said user's wrist is oriented palm down, said wrist band having means for carrying said timepiece, means for carrying said exercise routine card and means for displaying said exercise routine card.

2. An exercise aid as in claim 1 wherein said wrist band is an elastic sleeve adapted to be telescopically received over the hand of an user and disposed about the wrist of said user.

3. An exercise aid as in claim 2 wherein said timepiece is removably affixed to an exterior surface of said elastic wrist band.

4. An exercise aid as in claim 3 wherein said means for carrying said timepiece comprises a hook portion of a hook and loop fastener affixed on one surface at opposed ends of a watch strap wherein said hook portion is pressed into engagement with said exterior surface of said wrist band.

5. An exercise aid as in claim 1 wherein said pocket has an opening on at least one marginal edge thereof for telescopically receiving said exercise routine card therein.

6. An exercise aid as in claim 5 wherein said pocket has a transparent covering on the exposed face thereof for viewing said exercise routine card therethrough.

* * * * *